US008549702B2

(12) United States Patent
Chignoli et al.

(10) Patent No.: US 8,549,702 B2
(45) Date of Patent: Oct. 8, 2013

(54) FLOOR WASHING-DRYING MACHINE

(75) Inventors: Andrea Chignoli, Guardamiglio (IT); Andrea Odoli, Corteolona (IT)

(73) Assignee: Nilfisk-Advance A/S, Brondby (DK)

( * ) Notice: Subject to any disclaimer, the term of this patent is extended or adjusted under 35 U.S.C. 154(b) by 152 days.

(21) Appl. No.: 13/144,776

(22) PCT Filed: Jan. 5, 2010

(86) PCT No.: PCT/EP2010/050038

§ 371 (c)(1),
(2), (4) Date: Jul. 15, 2011

(87) PCT Pub. No.: WO2010/084030

PCT Pub. Date: Jul. 29, 2010

(65) Prior Publication Data

US 2011/0289700 A1 Dec. 1, 2011

(30) Foreign Application Priority Data

Jan. 22, 2009 (IT) ..... PN2009A0005

(51) Int. Cl.
*A47L 11/00* (2006.01)

(52) U.S. Cl.
USPC ..... 15/340.3; 15/49.1

(58) Field of Classification Search
USPC ..... 15/4, 340.3, 340.4, 320, 322, 401, 15/50.2, 50.3, 52.1, 82–87, 49.1, 340.1
See application file for complete search history.

(56) References Cited

U.S. PATENT DOCUMENTS

| | | | | |
|---|---|---|---|---|
| 3,701,177 | A | 10/1972 | Meyer et al. | |
| 5,016,310 | A | 5/1991 | Geyer et al. | |
| 5,881,417 | A * | 3/1999 | Knowlton | 15/52.1 |
| 2005/0005389 | A1 | 1/2005 | Rau et al. | |

FOREIGN PATENT DOCUMENTS

| | | |
|---|---|---|
| DE | 42 00 630 | 8/1992 |
| EP | 0 415 563 | 3/1991 |

OTHER PUBLICATIONS

U.S. Appl. No. 13/256,570, filed Sep. 14, 2011, Chignoli.
International Search Report issued May 25, 2010 in PCT/EP10/50038 filed Jan. 5, 2010.

* cited by examiner

*Primary Examiner* — Robert Scruggs
(74) *Attorney, Agent, or Firm* — Oblon, Spivak, McClelland, Maier & Neustadt, L.L.P.

(57) ABSTRACT

The present invention refers to a floor washing-drying machine, in particular of the drives-on-board kind, provided with at least a front driving and steering wheel (3), a pair of rear wheels (5), a brush-carrying head (4) positioned between the front driving wheel and the supporting axle of the rear wheels, and a wiping and vacuuming device (6) arranged behind the rear wheels. The brush-carrying head (4) is connected with the machine frame through a support and steering system of four-arm linkage type (X,Y,J,W; 17,19) which is driven by a gear steering device (11,12,14,15). The technical solution allows to solve efficiently the problem of collecting washing liquid and to dampen impacts of the machine against obstacles which it may encounter along its path.

4 Claims, 5 Drawing Sheets

FLOOR WASHING-DRYING MACHINE

TECHNICAL FIELD OF INVENTION

The present invention refers to a floor washing-drying machine, in particular of the driver-on-board kind, provided with an innovative brush-head support and swinging system.

BASIC TECHNIQUE OF INVENTION

As is well known, floor washing-drying machines are provided with a brush-carrying head that is normally positioned on the machine between the front driving wheel and the rear-wheel axle. The brush head dispenses the floor washing liquid. In the rear part of the machine and behind the rear wheels is installed the wiping and vacuuming device comprising at least one skirt in contact with the floor, to collect, suck up and dry off the washing liquid. Due to the geometry of the machine and position of the head and the wiping device with respect to the wheels, it is normal that at the turns along the path of the machine the liquid dispensed by the machine is not completely collected by the wiping device and is dispersed laterally outside the machine.

To avoid this problem, side flaps or deflectors are normally mounted on the sides of the head with the purpose of conveying the liquid toward the wiping and vacuuming device located in the rear.

Another drawback of these machines lies in the fact that the brush-carrying head is rigidly connected to the machine frame, to which it transmits the stresses due to impacts against any walls and obstructions that the machine meets along its operating path.

SUMMARY OF INVENTION

A main objective of the invention is therefore to eliminate the above-mentioned drawback by developing an effective and reliable solution that guarantees the complete collection of the washing liquid.

Another objective of the invention is to use the innovative solution also to effectively solve the problem of cushioning the impacts suffered by the machine during its operation.

These and other objectives will be achieved with a floor washing-drying machine according to the present invention as defined in the appended claims.

BRIEF DESCRIPTION OF DRAWINGS

Further characteristics and advantages of the present invention will become more evident from the following description of an embodiment given by way of non-limiting example with reference to the enclosed drawings, in which.

DETAILED DESCRIPTION OF INVENTION

Figure 1:
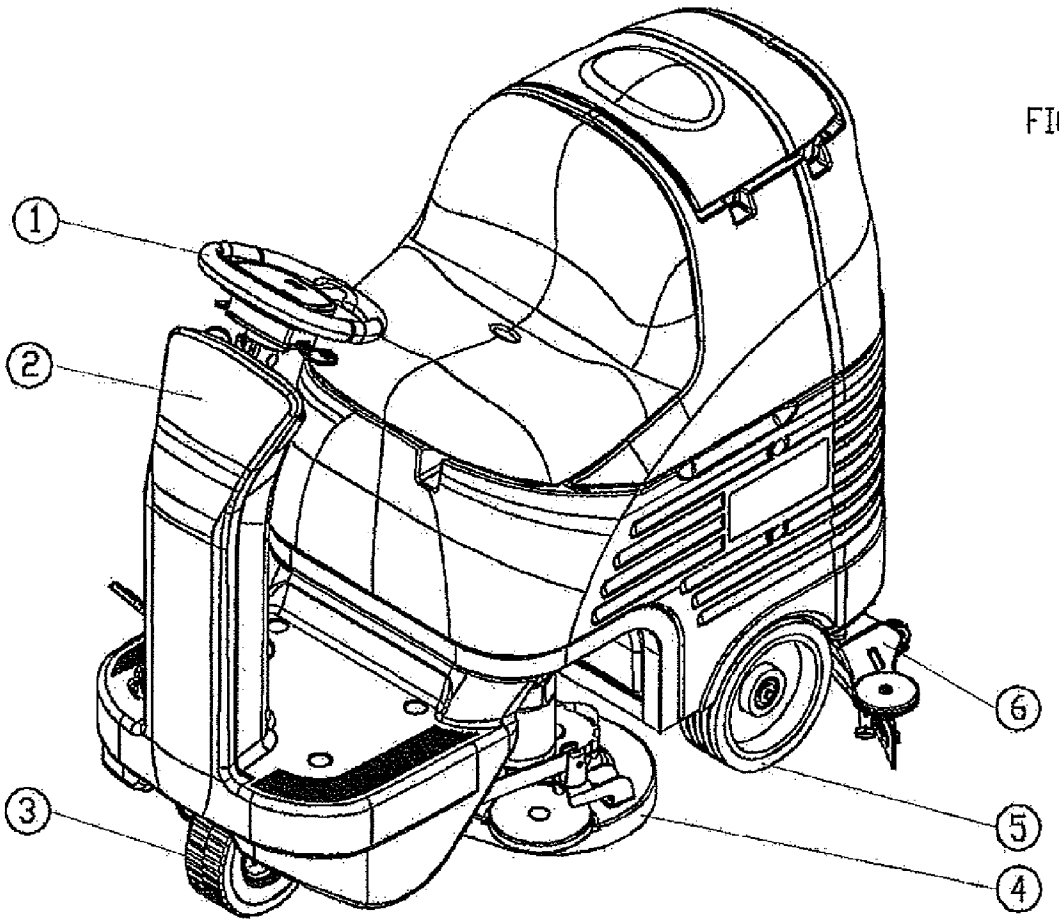
FIG. 1 shows a perspective view of a floor washing-drying machine according to the invention.

FIG. 1 shows a floor washing-drying machine of the driver-on-board type according to the invention. The machine normally includes a steering wheel (1) which, through a steering column (2), controls a driving and steering front wheel (3). A brush-carrying head (4) is installed under the machine frame, in a substantially central position between the front wheel (3) and the axle of the rear wheels (5). The head (4), which is fed the washing liquid from the tank (not shown) on the machine, supports a pair of rotating brushes mounted on vertical shafts that spread the liquid and wipe the floor. In the rear part of the machine and behind the rear wheels (5) is installed a wiping and vacuuming device (6), which includes at least one apron strip in contact with the floor, to collect, vacuum and dry the washing liquid spread on the floor.

Figure 2:
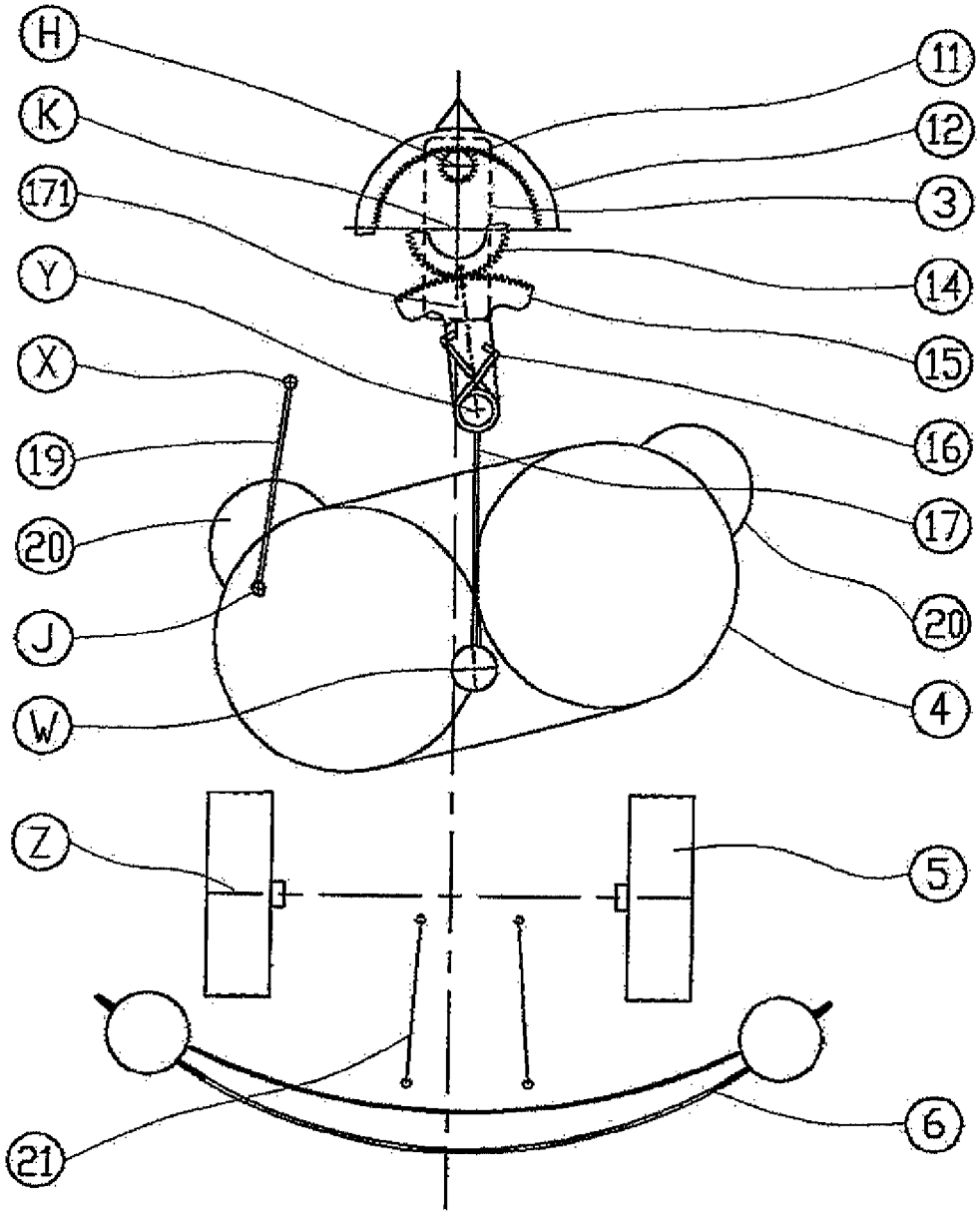
FIG. 2 schematically illustrates a top view of the brush-head control mechanism.

FIG. 2 is a schematic top view of the innovative system applied to the machine of FIG. 1 controlling the brush-carrying head (4). A gearwheel (11) is rotated, by the steering wheel (1) through the steering column (2), in a substantially horizontal plane and around a vertical axis (H) of the machine frame. The gear (11) engages an internally toothed half-ring gear (12), which turns around a vertical bar (K) together with an externally toothed half-ring gear (14). On the vertical bar (K) is also pivoted the front wheel (3) of the machine, so that the rotation of the steering wheel (1) is transmitted to both the half-rings (12 and 14) and to the machine driving and steering wheel (3).

The toothed half-ring (14) engages a toothed sector (15) that is hinged to a vertical bar (Y) of the frame. The toothed sector (15) is associated to a spring (16), that is wound around the bar (Y) and through which the toothed sector (15) swings an arm (17) of a four-arm linkage system that includes a further arm (19). As is better shown in FIG. 5, the spring (16) has one end fastened to the bar supporting the toothed gear (15) and its other end is fastened to an extension (171) of the arm (17).

The arm (17) is hinged to the bar (Y) fastened to the machine frame, and at one end it is connected to a bar (W) fastened to the brush-carrying head (4). Said extension (171) extends in an axial direction opposite the direction of the arm (17) with respect to the hinge bar (Y).

Similarly, the arm (19) is hinged at one end to a bar (X) fastened to the machine frame and at the other end it is fastened to a bar (J) fastened to the brush-carrying head (4). Therefore, the two arms (17 and 19) connect and support the brush-carrying head (4) with respect to the machine frame.

In the rear part of the machine, the wheels (5) are supported by an axle (Z) and behind them is installed the wiping and vacuuming device (6), which is connected to the machine frame through a four-arm linkage system (21) so that the wiping and vacuuming device swings in the same direction toward which the machine is steered. The wiping device and the relative control system are completely conventional for this type of machines and therefore are not described in detail.

Figure 3:
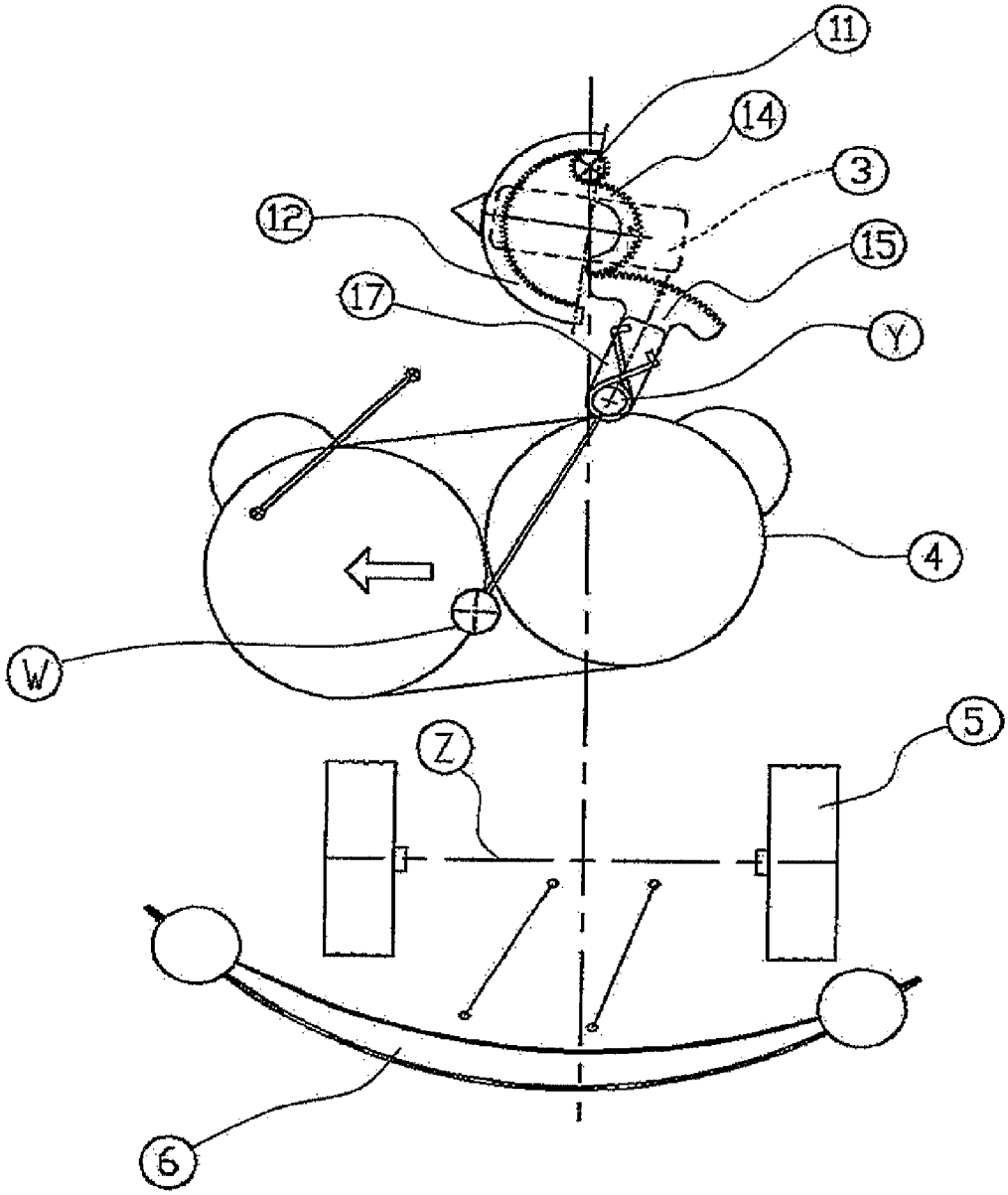
FIGS. 3-5 schematically illustrate a view from above of three different operating conditions of the brush-head control mechanism.
Figure 4:
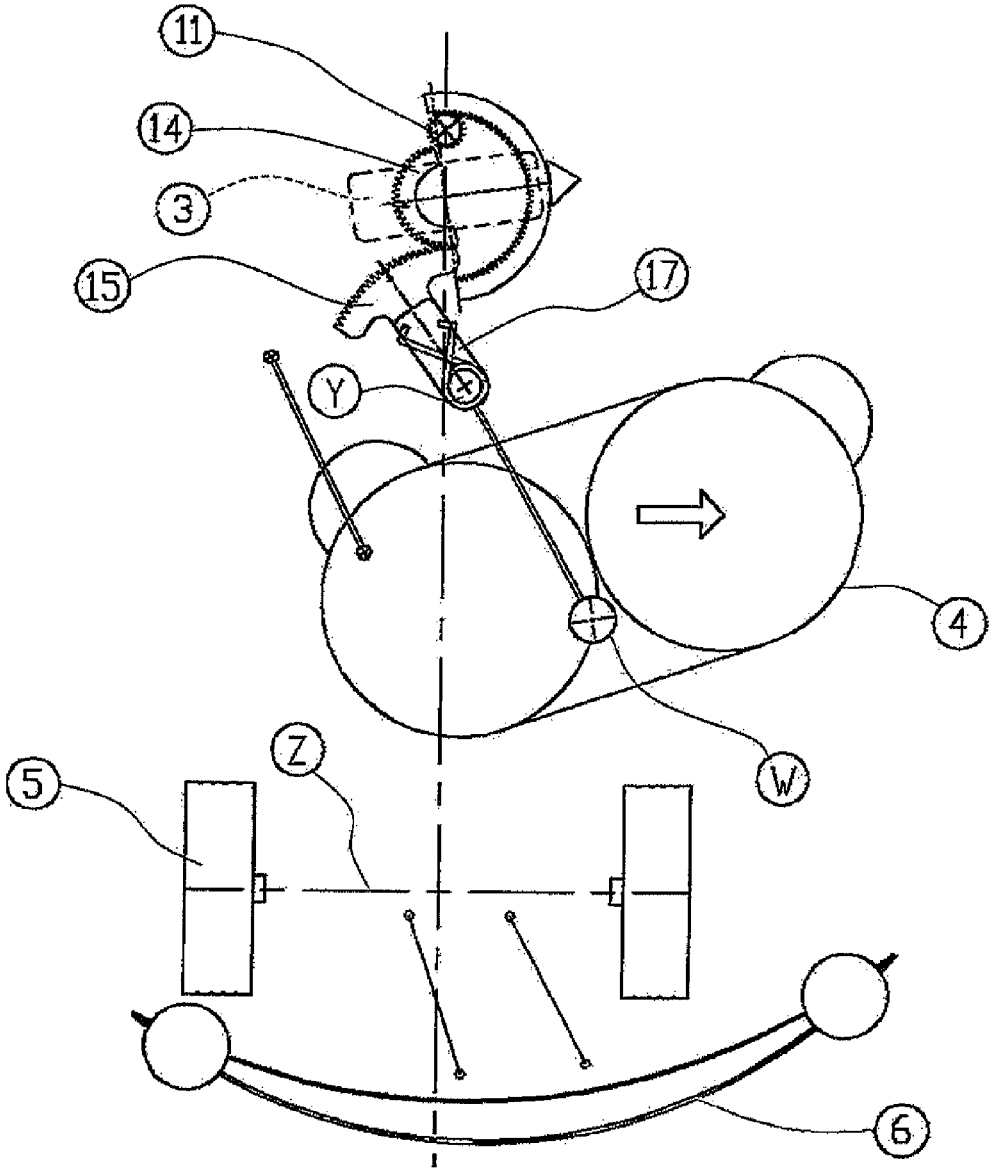

FIGS. 3 and 4 schematically illustrate the behaviour of the machine, particularly the brush-carrying head (4), when the steering wheel (2) is steered to make a turn.

As shown in FIG. 3, when the gearwheel (11) is steered toward the left it rotates the half-ring (12) and the front wheel (3) in the same direction, while through the half-ring (14) it causes the rotation of the toothed sector (15) in the opposite direction. Together with the latter, it rotates the arm (17) around the arm (Y), thus causing the arm (W) to move toward the left, that is, in the steering direction. Consequently, the brush-carrying head (4) is caused to move with a swinging-translation movement toward the inside of the curve.

Similarly, FIG. 4 shows how steering the four-arm linkage mechanism causes the brush-carrying head (4) to move toward the right.

Therefore, when the machine is steered in one direction, for example toward the left, both the brush-carrying head (4) and the wiping and vacuuming device (6) are made to move in the same direction. In this manner, the liquid left on the floor is intercepted directly by the wiping and vacuuming device and completely removed.

Figure 5:
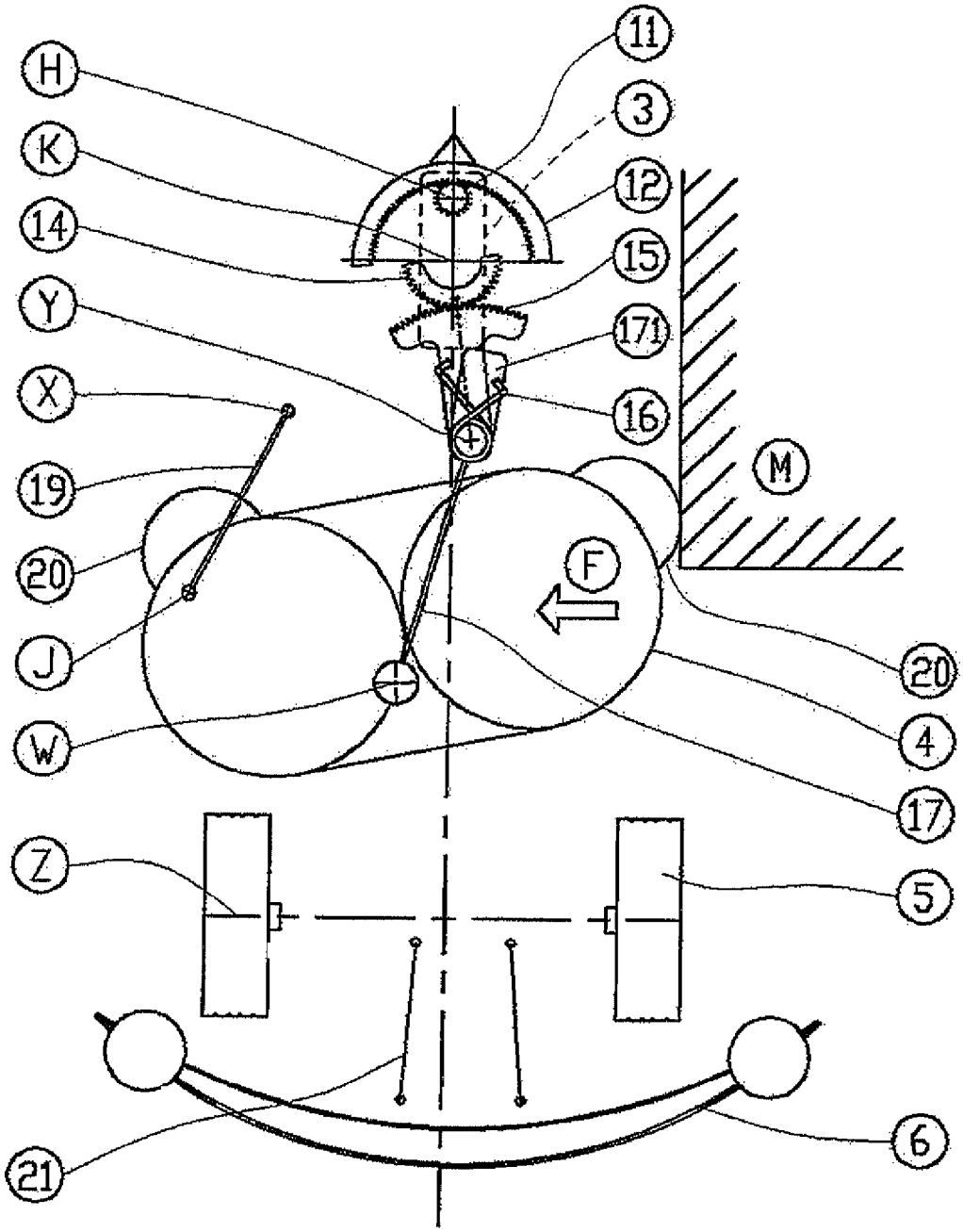

FIG. 5 shows schematically how the innovative control system of the brush-carrying head (4) behaves in case of impacts against any obstruction that the machine may encounter, represented in the figure by a wall (M). Normally, the brush-carrying head (4) is provided with bumper rolls (20), as shown in FIGS. 2 and 5. These rolls allow a limited absorption of the impact energy that is discharged on the support of the brush-carrying head (4), and from there to the machine frame.

With the solution according to the present invention, in case of impact the brush-carrying head (4) is thrust in the direction of the arrow (F), causing a clockwise rotation of the arm (17) around the arm (Y). The spring (16) partially relieves the movement of the arm (17), and consequently the brush-carrying head (4), with respect to the steering system comprising the gears (15, 14, 12 and 11), causing the head to be partially floating and cushioned with respect to the steering gear. In this manner, in the presence of an obstruction, the brush-carrying head (4) can move elastically under the body of the machine even with the steering gear straight and without recoils on the same. This makes it possible to discharge the energy of the impact on the spring without excessively straining the system supporting the brush-carrying head (4) and to avoid the danger of damaging the head itself.

The solution described above therefore achieves the result of solving the problems indicated in the introductory part of the present description, through the construction of a simple and effective brush-head support and swinging system.

The invention claimed is:

1. A floor washing-drying machine, comprising:

a chassis;

a steering wheel to receive steering input from a user;

a front wheel for driving and steering the machine, connect to the steering wheel;

a pair of rear wheels connected by an axle;

a linkage support;

a brush-carrying head-piece between the front wheel and the axle which is supported by the linkage support; and a wiping and vacuuming device behind the rear wheels, wherein the brush-carrying head-piece is connected to the chassis of the machine via the linkage support and is actuated in a horizontal plane by the steering wheel of the machine through a geared steering device such that movement of the steering wheel causes movement of the brush-carrying head-piece, relative to the chassis.

2. The floor washing-drying machine according to claim 1, wherein:

the linkage support comprises a four bar linkage support and swinging system including two arms hinged on two bars attached to the chassis of the machine and two bars attached to the brush-carrying head-piece, respectively.

3. The floor washing-drying machine according to claim 1, wherein the geared steering device comprises:

a gear connected to the steering column of the machine and to rotatably operate two half-ring gears, the first half ring gear to actuate the front wheel, and the second half ring gear to engage a sector gear to actuate an arm of the linkage support.

4. The floor washing-drying machine according to claim 3, wherein:

the sector gear of the geared steering device is hinged on a bar of the linkage support which is attached to the chassis of the machine, and is linked to an extension of the bar via a spring.

* * * * *